United States Patent [19]

Krumlauf

[11] 4,336,939

[45] Jun. 29, 1982

[54] GOLF CHIP AND PUTT PRACTICE DEVICE AND GAME

[76] Inventor: Alfred C. Krumlauf, 1450 North Avenue, NE., Atlanta, Ga. 30307

[21] Appl. No.: 213,307

[22] Filed: Dec. 5, 1980

[51] Int. Cl.[3] ..... A63B 69/36

[52] U.S. Cl. ..... 273/185 R; 273/176 FB; 273/182 R; 273/183 A; 273/180

[58] Field of Search ..... 273/181 A, 181 F, 182 R, 273/398, 399, 400, 401, 176 FB, 185 R, 184 R, 183 A, 180

[56] References Cited

U.S. PATENT DOCUMENTS

| | | | |
|---|---|---|---|
| 715,249 | 12/1902 | Dunbar | 273/401 |
| 757,440 | 4/1904 | Croxford | 273/401 X |
| 1,537,809 | 5/1925 | Easton | 273/181 A |
| 1,923,152 | 8/1933 | Kohn | 273/181 A |
| 2,450,125 | 9/1948 | Dunfee | 273/181 R |

FOREIGN PATENT DOCUMENTS

| | | | |
|---|---|---|---|
| 13201 | of 1887 | United Kingdom | 273/400 |

*Primary Examiner*—George J. Marlo
*Attorney, Agent, or Firm*—Newton, Hopkins & Ormsby

[57] ABSTRACT

A golf chip and putt target formed of flexible sheet material is pocketed to form a center pocket, pairs of longitudinal and lateral pockets each sharing a common wall with the center pocket and corner pockets diagonally arranged with respect to the center pocket. The square target includes a border flange which rests upon and is attached to a level frame supported by front and rear pairs of U-legs. These legs mount sleeves of a flexible back stop having side and rear walls and being open at the front to form a ball collection and return trough around the sides and rear of the target. An inclined approach ramp at the front of the target leads to a putting green surface having ball site markings thereon. A teeing mat with ball locator markings is provided at the forward end of the putting green surface. An electrical score keeping embodiment having an automatic ball return is disclosed.

10 Claims, 9 Drawing Figures

GOLF CHIP AND PUTT PRACTICE DEVICE AND GAME

BACKGROUND OF THE INVENTION

Numerous prior art teachings exist pertaining to indoor and outdoor golf simulating games and practice devices. Some of these prior art teachings are highly sophisticated and very expensive to manufacture and maintain, while others are very simplified and therefore present little in the way of a challenge to golfers.

The present invention seeks to fulfill a need in the art for a genuine chip and putt golf practice device and amusement device through which golfers can actually improve their skills in the chip and putt phase of the game. In achieving this objective, the invention also affords an interesting game of skill for players of all ages who may or may not be interested in the actual game of golf.

An objective of the invention is to provide an apparatus for achieving the above-stated aims with minimum expense of manufacturing and maintenance in a purely mechanical arrangement and in an electrified score keeping embodiment. In either case, the game apparatus features prefabricated target formed of flexible material and pocketed to form several scoring pockets of increasing value away from a center smallest pocket of unit value. The target which is square attaches to an elevated level support frame which in turn rests on corner leg units which support a three sided flexible back stop for balls. The back stop forms a three sided return trough for balls which also constitutes a scoring zone of highest numeric value and lowest achievement, in correspondence to the scoring system for golf. An approach ramp at the front of the target and an elongated putting green simulating level pad with teeing component impart realism to the game and practice apparatus in a manner distinctly different from the known prior art.

Other features and advantages of the invention will become apparent during the course of the following description.

DETAILED DESCRIPTION

Figure 1:
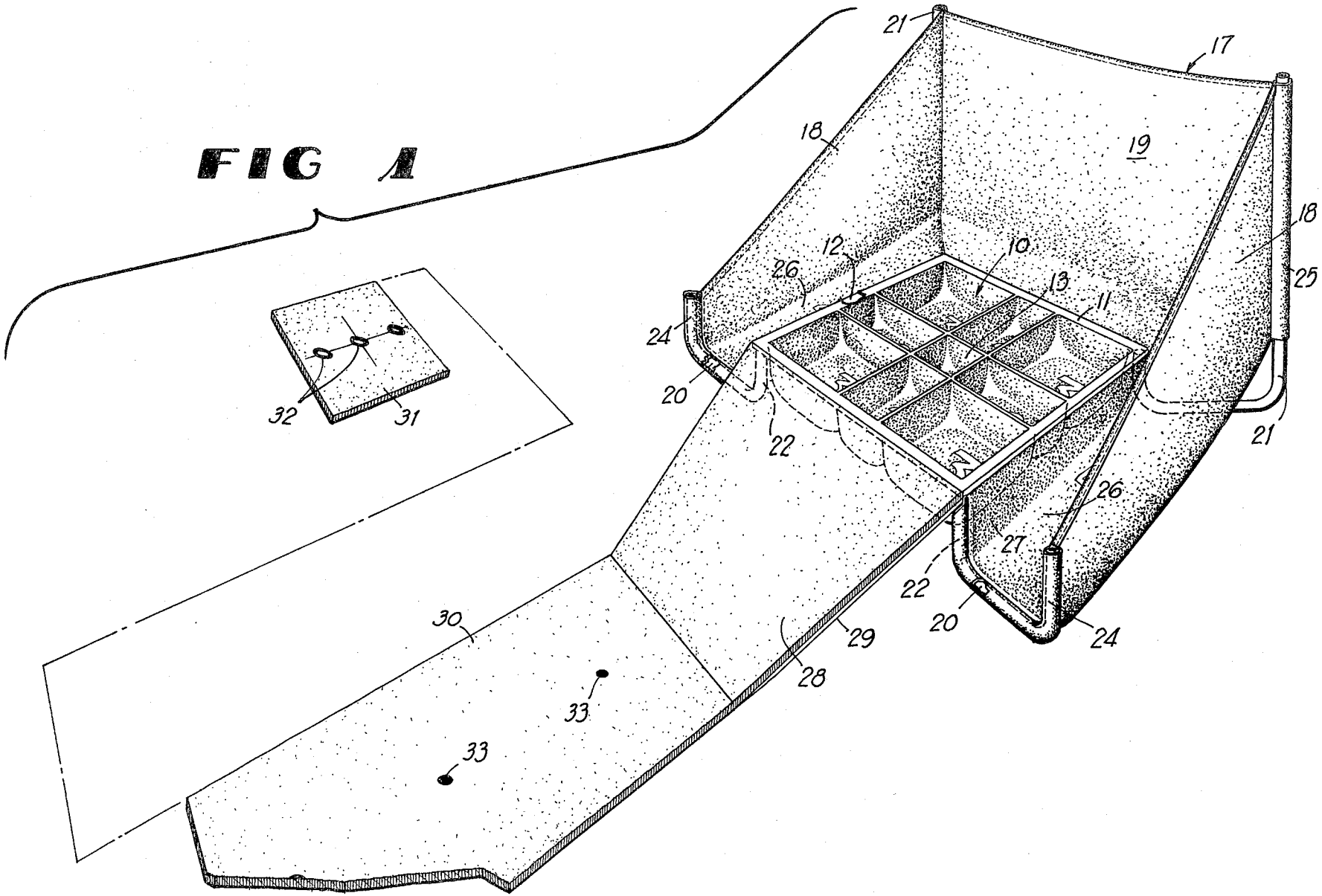
FIG. 1 is a fragmentary composite perspective view of the invention, according to one embodiment.
Figure 2A:
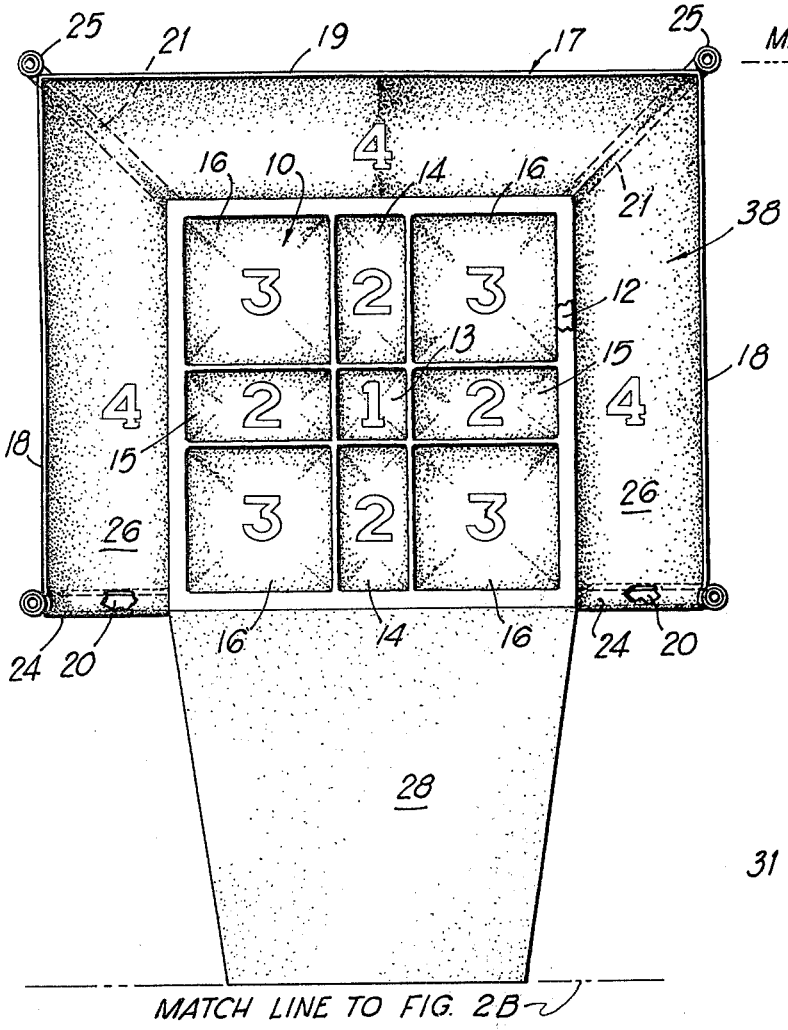
FIGS. 2A and 2B taken together form a plan view of the complete apparatus in FIG. 1.
Figure 2B:
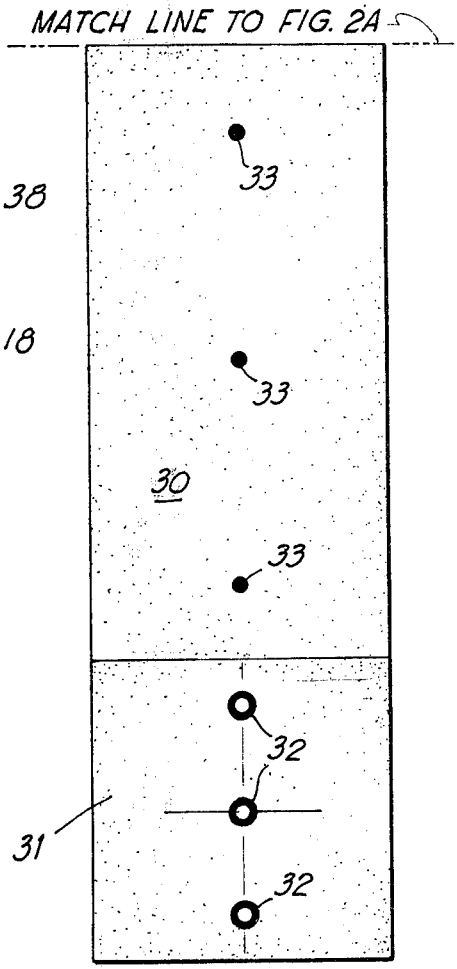
Figure 3:
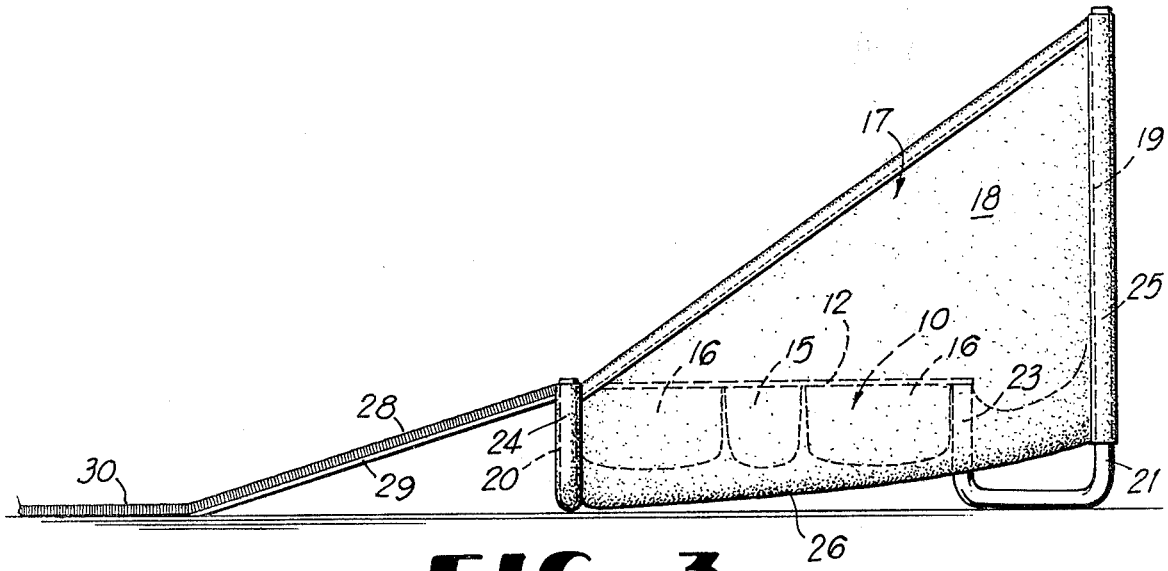
FIG. 3 is a fragmentary side elevation of the apparatus.
Figure 4:
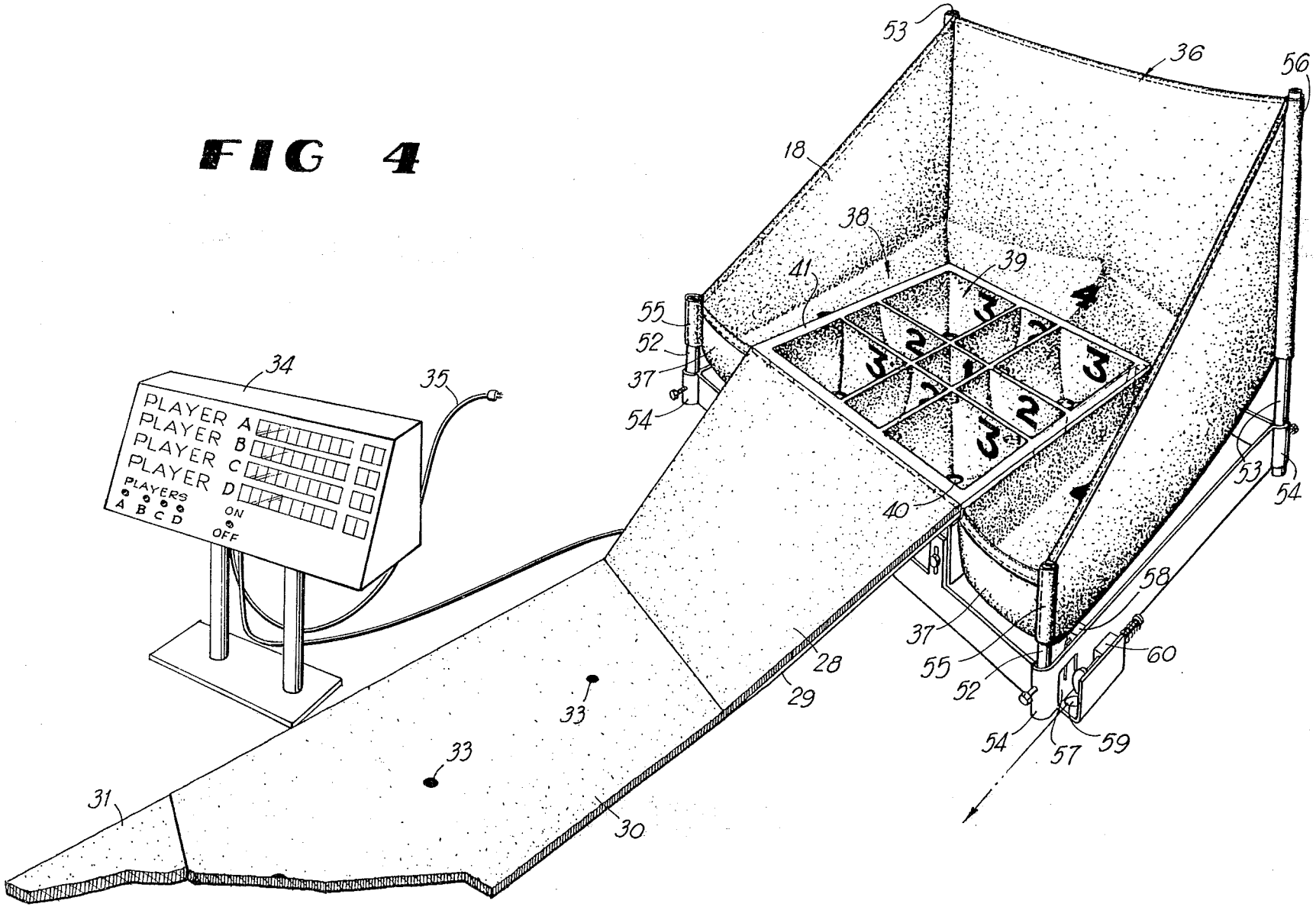
FIG. 4 is a perspective view, similar to FIG. 1, showing a second embodiment which includes automatic score keeping and ball return features.

Referring to the drawings in detail wherein like numerals designate like parts and initially considering FIGS. 1 through 3, a prefabricated target 10 formed of fabric or other flexible sheet material is preferably square and includes an integral horizontal border flange 11 which rests on and is suitably attached to and supported by an underlying substantially rigid horizontal square frame 12. The border flange 11 can be attached to the frame 12 permanently as by rivets or separably by snap fasteners or the like. When separated from the frame 12, the flexible target 10 can be collapsed or folded into a small mass for packaging or storage.

The prefabricated target 10 is constructed to form a plurality of pockets when in the expanded use position on the frame 12. A smallest square center pocket 13 is suitably marked with the numeric value 1 or score value of highest achievement in the game of golf. A pair of aligned longitudinal rectangular pockets 14 sharing the front and back walls of the center pocket are marked with the score value 2 and a pair of aligned side pockets 15 of the same shape and size as pockets 14 share common side walls with the center pocket 13. The pockets 15 have the same score values as the pockets 14, as shown in the drawings.

The target 10 further comprises comparatively large square corner pockets 16 diagonally disposed relative to the center pocket 13 and having the score value 3 marked thereon.

The device additionally comprises a ball arresting back stop 17 also formed of flexible sheet material including substantially vertical side walls 18 and a rear wall 19, the back stop being forwardly open and surrounding the target 10 on three sides with the walls 18 and 19 equidistantly spaced from the corresponding sides of the target 10. The front of the target 10 is flush with the open side of the back stop 17.

The flexible back stop 17 is supported by front and rear U-legs 20 and 21. The inner upright portions 22 and 23 of these U-legs are also attached to and support the four corners of the square frame 12 in a level position and at a proper elevation above the floor or ground to enable the pockets 13–16 to drape fully downwardly in their open positions. The target pockets maintain their shapes due to the divider walls between them being held substantially taut by the frame 12.

Sleeve formations 24 and 25 integral with the back stop 17 engage over the outer upright portions of U-legs 20 and 21 to support the flexible back stop in the open use position thereon. The back stop 17 is separable from the U-legs for folding into a compact form. The back stop includes an integral forwardly and downwardly sloping floor 26 and an interior substantially vertical side wall 27 which extends around the sides and rear of target 10 and may be attached to the horizontal frame 12 by any suitable means. The floor 26 and interior wall 27 form a continuous inclined trough around three sides of the target which is sloped to cause balls striking the back stop and entering the trough to be returned by gravity through the forward open side of the back stop and toward the game player who is stationed well forwardly of the back stop and target. The U-shaped trough formed by the back stop around the target 10 is marked with the score value 4, as shown in FIG. 2A, and this score is given to players whose golf balls enter the trough of the back stop. Balls missing the back stop entirely receive no score, or possibly a penalty score under possible variations of the rules of play.

The device further comprises an inclined approach ramp 28 for balls whose elevated end is suitably attached to the front of frame 12. This ramp includes a rigid backing panel 29 which supports a suitable artificial grass carpet section. Leading forwardly from the ramp 28 is a further strip 30 of artificial grass carpet representing a putting green and a putting or teeing pad 31 of similar material placed at the forward end of the green strip 30, FIG. 2B.

Preferably, the teeing pad 31 has three spaced longitudinally aligned ball placement circles 32 painted thereon. The ball placement circles 32 are of a donut configuration and diameter such that the printed annular ring may be seen before striking the ball. This provides for a sight target to be viewed after the ball has been struck. This is a beneficial training device in maintaining the head in a down position after striking the ball to facilitate a smooth follow through without pulling the shoulders up. Longitudinally aligned aiming dots 33 are provided along the green strip 30 to aid the player in achieving accuracy in putting and/or chipping. The length of the green strip 30 and therefore the spacing of the pad 31 from the target 10 can be varied to suit the needs of various players, such as adults or children.

The use of the invention is both entertaining and challenging. It can be of real assistance to golfers in perfecting certain phases of their game. The structure is extremely simple and low cost and can be stored away in a minimum of space due to the flexible nature of the target 10 and back stop 17 and the separability of the frame 12 from the target 10 and U-legs 20 and 21.

In another embodiment of the invention shown in FIGS. 4 to 8, substantially the same structure above-described is employed with certain electrical and mechanical features to achieve automated scoring and ball return to the player area.

More particularly in FIGS. 4 to 8, a state of the art electrical scoring console 34 is utilized and powered through a cable 35 which can be plugged into a source of 110 volt AC. Basically the same flexible back stop is utilized indicated by the numeral 36 and differing from the back stop 17 principally by the inclusion of forward closure walls 37 for the ball collecting trough 38 formed around three sides of the flexible target 39.

The flexible target 39 has the same pocketed arrangement and scoring values as described above for the target 10. It differs from the target 10 in that the bottom of each target pocket has a center ball outlet opening 40 formed therethrough.

Figure 6:
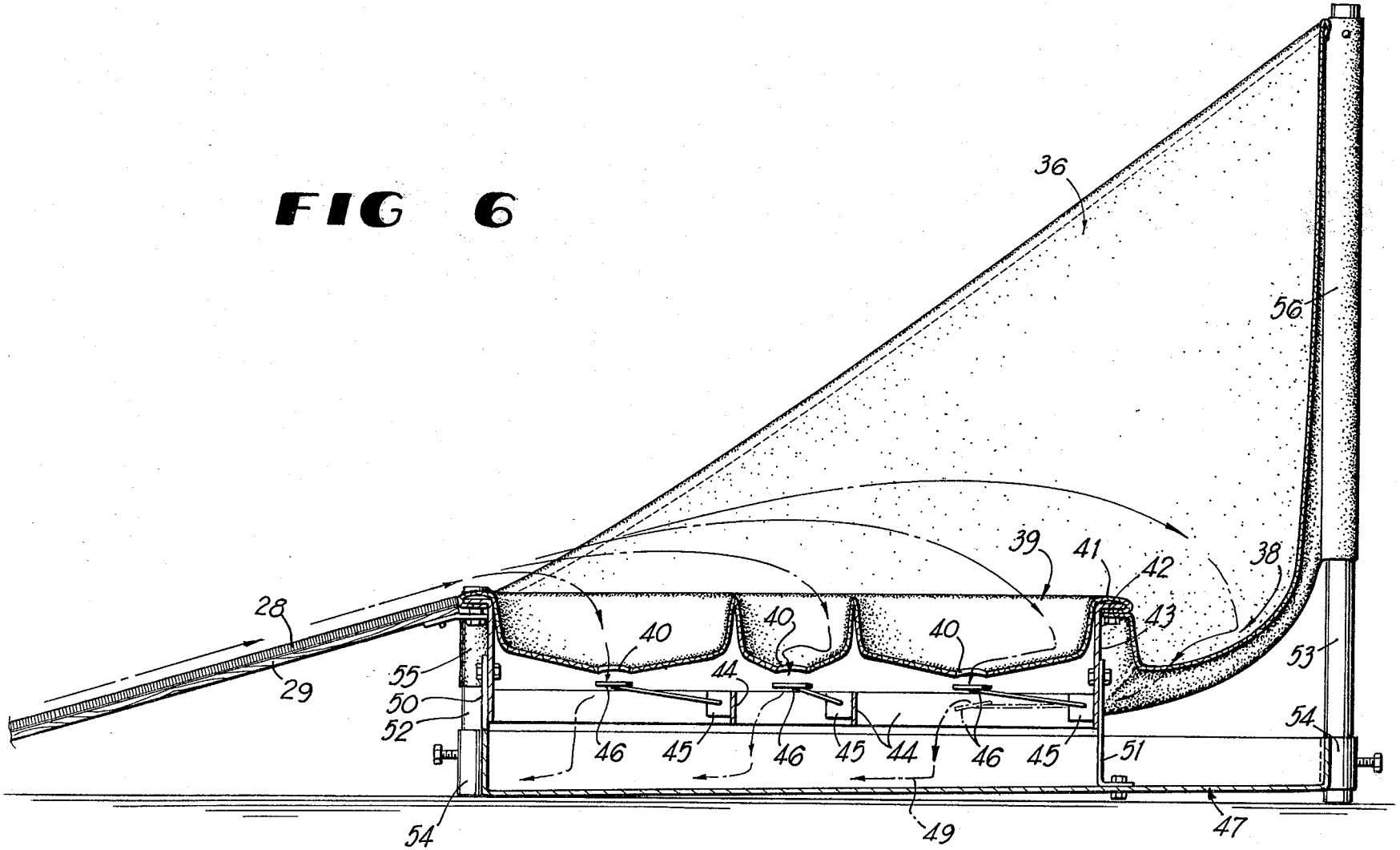
FIG. 6 is a longitudinal vertical section taken centrally through the apparatus of FIG. 4.
Figure 7:
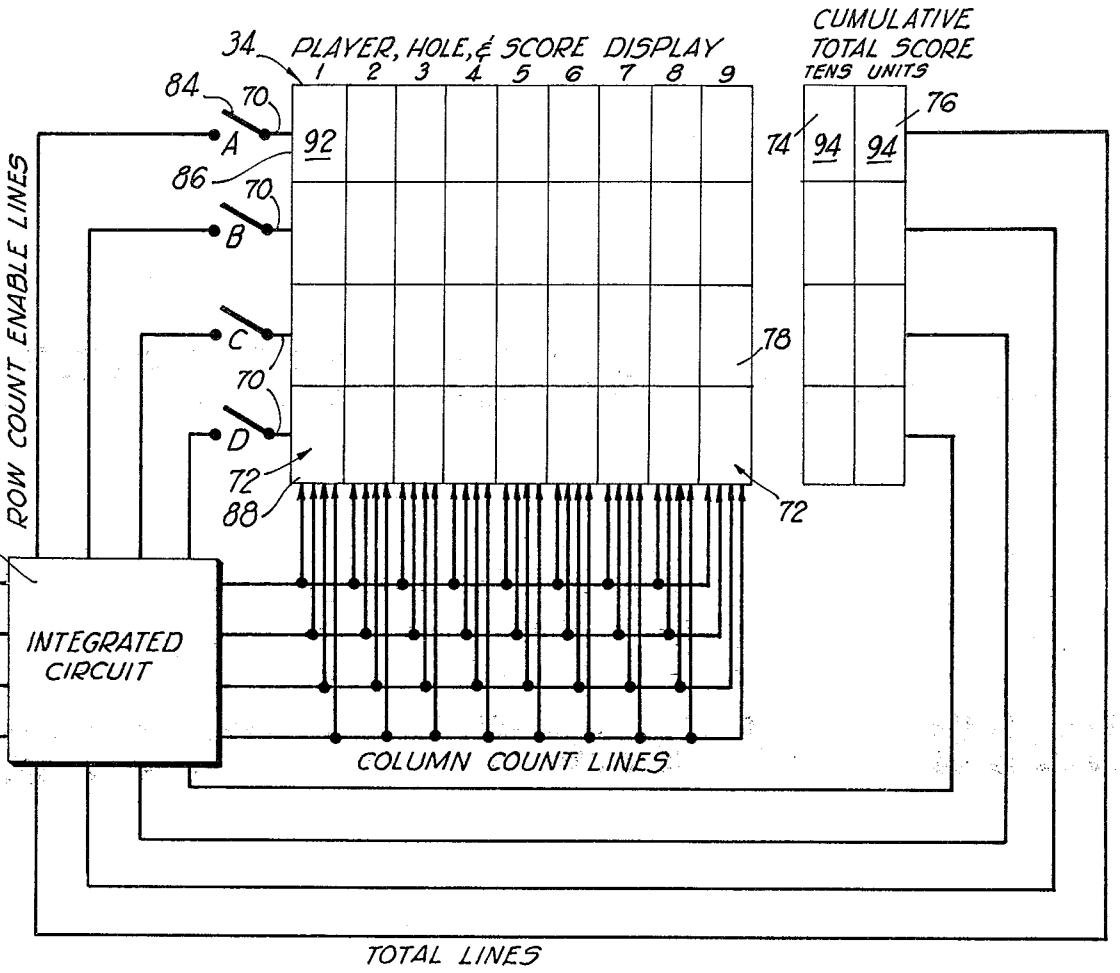
FIG. 7 is a diagrammatic electrical diagram of the scoring console showing how a hole score and total score for a given player is registered on the console by the triggering of the row count enable lines from the player buttons together with the score input from the game scoring switches through an integrated circuit.
Figure 8:
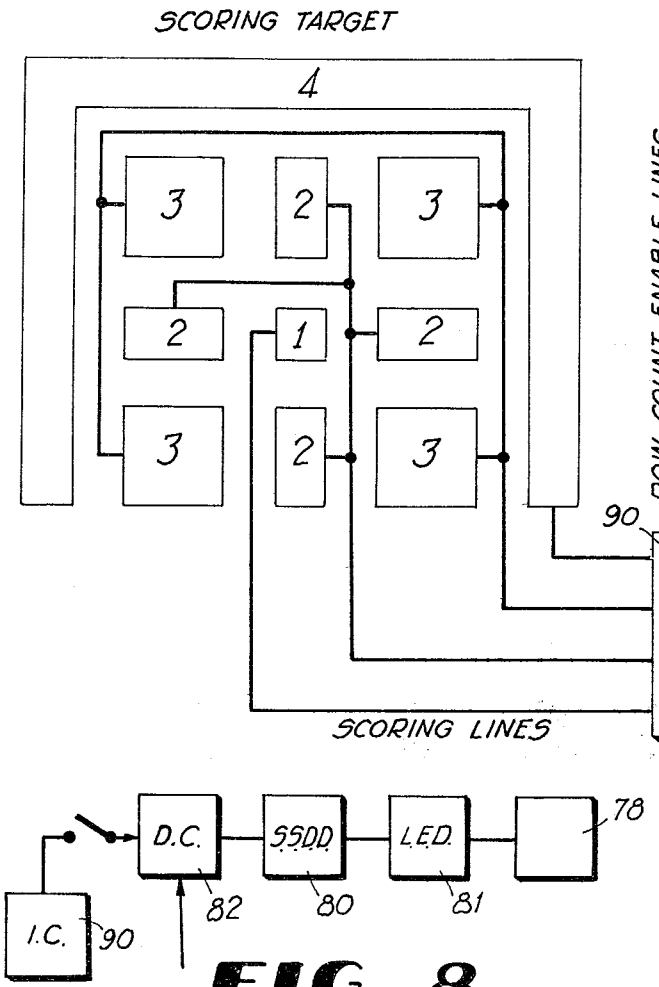
FIG. 8 is an electrical diagram of a light emitting diode score display.

As in the prior embodiment, a horizontal border flange 41 of the flexible target 39 is suitably attached as by rivets or bolts to a rigid support frame 42 having a depending vertical wall 43 around the four sides thereof. As best shown in FIG. 6, the target 39 nests inside of the walls 43 depending from frame 42 with the target supported horizontally at a sufficient elevation to enable the target pockets to hang in fully open positions with the ball outlet openings 40 lowermost and the walls of the pockets sloping in all directions toward these openings.

Figure 5:
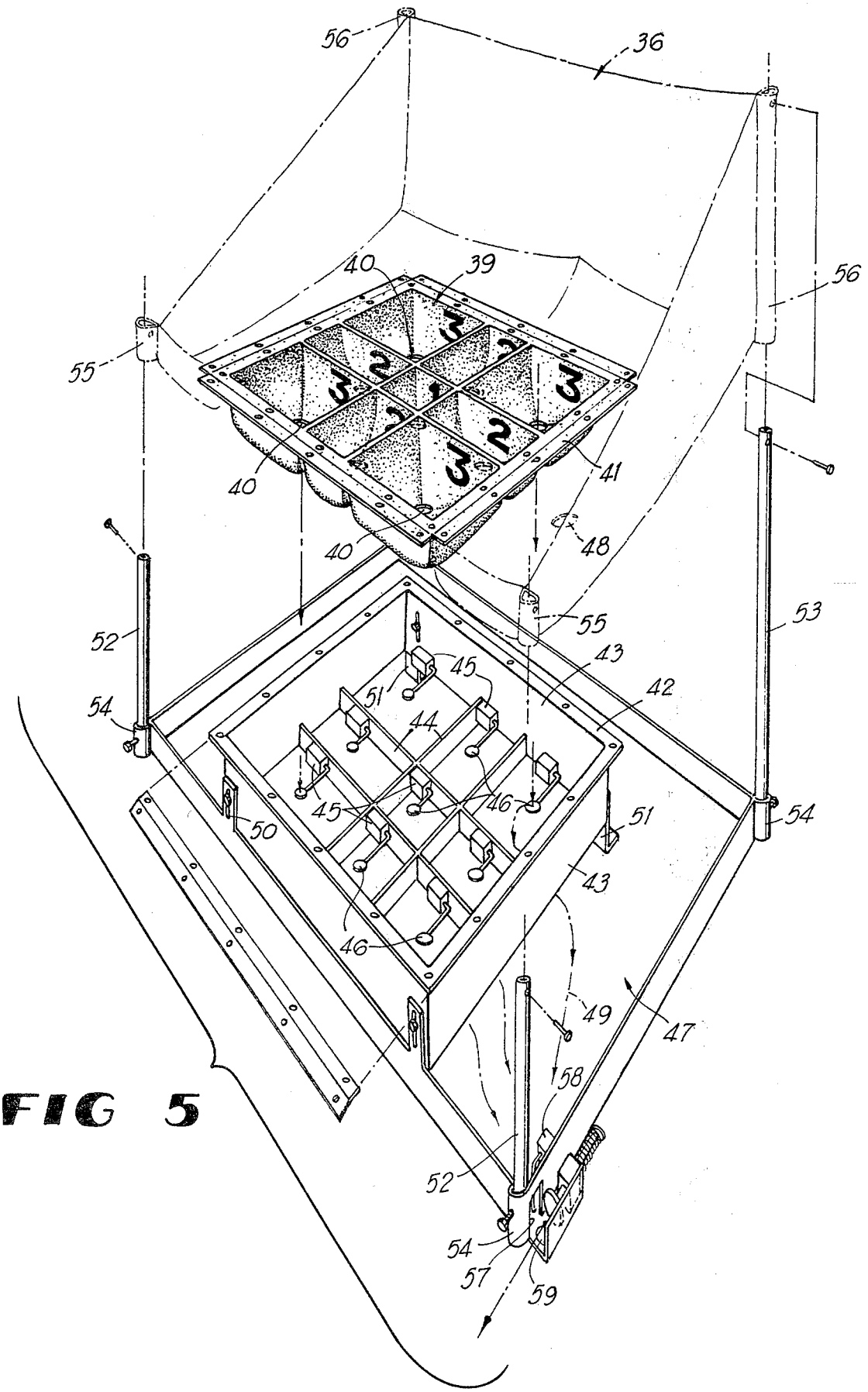
FIG. 5 is an exploded perspective view of components in FIG. 4.

A gridwork of orthogonally arranged support panels 44 for ball sensing electrical switches 45 is secured to the walls 43 adjacent their lower edges. Some of the switches 45 are attached directly to the rear wall 43 as shown in FIGS. 5 and 6. Each ball sensing switch has a pivoted actuator 46 located immediately below one opening 40 and adapted to respond to the pressure of a ball falling through the opening 40 by moving to the position shown in phantom lines in FIG. 6. In such position, an electrical circuit including the particular switch associated with the depressed actuator is energized for entering a score for a particular player on the score keeping console 34, corresponding to the score value assigned to a particular pocket of the target 39, via cord 35', as fully described in the preceding embodiment.

The apparatus further comprises a lower shallow tray 47 forming a return course for balls passing through the openings 40 and through a like opening 48 in the floor back stop 36. The slope of the tray 47 can be adjusted to cause the balls to roll toward one forward corner thereof, as shown by the directional arrows 49 in FIG. 5.

The unit consisting of target support frame 42, depending walls 43 and support partitions 44 is vertically adjustably held on slotted extensions 50 at the front of tray 47 and on vertical brackets 51 near the rear of the tray. By this means, the target 39 can be leveled and supported at the proper height above a floor or ground.

Rising vertical standards 52 and 53 at the front and back of the tray 47 are detachably coupled therewith as at 54. Flexible sleeves 55 and 56 formed on the target 36 telescope over the standards 52 and 53 to removably support the flexible target thereon in the expanded use position generally as described in the prior embodiment. The apparatus possesses the previously-described ramp 28, simulated green 30 with alignment dots 33, and the teeing mat 31, all serving the same purposes as in the prior embodiment.

Balls passing through any pocket opening 40 or through the return openings 48 in the sloping floor of the trough formed by back stop 36 fall into the pan 47 whose inclination is adjusted to cause the balls to roll toward an outlet passage 57 at such corner. Within the pan 47 adjacent the outlet passage 57 is a sensing switch 58 whose actuator is tripped by a ball rolling through the outlet passage onto a ball seat 59 ahead of an electrical solenoid 60 which after a brief time delay interval forcibly projects the ball from the seat 59 and returns it automatically to the player area near the teeing pad 31. Another function of the sensing switch 58 is to enter the score value 4 on the console 34 where none of the other switches 45 have been actuated by a ball, meaning that such ball has never entered a pocket of the target 39 but has fallen directly into the return trough of back stop 36.

In all other respects, the invention in FIGS. 4 through 8 is substantially the same as in the prior embodiment already described.

The scoring console 34 consists of four player rows 70 one for each player which are designated A, B, C and D and nine hole columns 72 one for each hole plus a tenth and eleventh display columns 74 and 76 that show the cumulative total of each player in tens and units.

Each display window 78 requires a standard digital SSDD (Seven Segment Decoder Driver) 80 which receives the digital signal which it translates into the correct numbered bars (from 1 to 7 bars) to display on the Light Emitting Diode (LED) 81 the correct (arabic) number for the hole score and cumulative total. The digital signal for the SSDD 80 comes from a Decode Counter (DC) 82.

Description of the sequence of electrical circuitry is as follows:

The first player activates a player button 84 by pushing the A button. If coin operated—player button only will work if a required amount of money is inserted, i.e. the required coin or coins per player. With the A button pushed ALL of the horizontal row 86 for "A" player in LED display are partially enabled. Also at beginning ALL of the vertical column 88 (hole 1) displays are also partially enabled;

Therefore since each display LED 81 requires two enable inputs (player and hole) only player A and hole 1 displays are now fully (doubly) enabled.

Any ball sensing switch 45 or 58 of a cup pocket 39 of given value or opening 48 which is activated by a ball sends a signal to an integrated circuit 90 which translates this hole value to digital signals which now will be displayed on player A—hole 1 LED display 92, as well as, through a totalizer, be displayed on player A total LED display 94.

Activation of player B or subsequent player buttons will likewise display the proper hole count, and total, on that player's hole 1 LED display and total.

When each player has completed his shots for hole 1, player A's second activation of his player A button causes a digital count circuit to partially enable all player LED displays in hole 2 column and since player A button has again partially enabled all of the player A row then the next shot value will be displayed on player A-hole 2 LED display and also having been added into player A cumulative adder, which will now add player A's second hole to his previous hole total, held in memory, to now display total of hole 1 and hole 2 for player A in player A total LED display.

At this time, as player B's turn comes up and he activates his "B" button the second time, the row for player B is again now partially enabled and together with the partial enabling of the column for hole 2 (from player A's second previous activation) the shot value now attained by player B's turn will record on player B-hole 2 LED display. Also this shot value—added to B's previous total will now be displayed on player B's total. This particular sequence is shown diagrammatically in FIG. 7.

Since the game is intended to be played in two modes, one shot per player for each hole or two shots per player, an additional function of the IC circuitry is to prevent any player from making more than two shots per hole. This is done by a 2-shot lockout circuit which will add the value of a second shot to that of the first shot for a player and totalize not only in the hole register but also in the cumulative total but will, however, not register any further shots until another player button is activated. This prevents inadvertent shots being added to a player's total.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A golf game apparatus comprising a pocketed target formed of flexible sheet material and having a marginal flange thereon, an underlying support frame for the marginal flange attached thereto and supporting the target in a level mode at an elevation where the pockets of the target are suspended in an open state, corner support legs for said frame including exterior upright portions spaced outwardly of the frame and target and interior upright portions, a flexible sheet material backstop including a lower ball return through surrounding said target on three sides and attached to and being supported by said upright portions, and said corner support legs being U-shaped with the interior upright portions thereof underlying corners of said frame and said exterior upright portions receiving flexible sleeves formed on said backstop.

2. A golf game apparatus as defined in claim 1, and an automatic electrical score keeping console for the apparatus, the individual pockets of the target each having a ball outlet opening, and an electrical sensing switch including an actuator disposed below each ball outlet opening and being depressed by a ball passing through such opening to energize a scoring circuit which includes the switch and said console.

3. A golf game apparatus as defined in claim 2, and a ball return pan beneath said target back stop and said switches and having a single ball return passage through which each ball entering the pan must roll, an electrical ball sensing device adjacent said passage and being in an electrical circuit with said console, and an electrical ball projector adjacent said passage and electrically connected with said sensing device and operable to project each ball toward a game player area forwardly of said target.

4. A golf game apparatus as defined in claim 3, and a support for electrical sensing switches below said target and above said pan and being attached to said support frame.

5. A golf game apparatus as defined in claim 4, and said support frame being rectangular and having depending side walls, and said support for said switches comprising an orthogonal gridwork of panels secured to said side walls.

6. A golf game apparatus as defined in claim 5, and means forming vertically adjustable connections between said walls and said pan whereby the level of the target and said switches can be adjusted relative to said pan.

7. A chip and putt golf practice device and game apparatus comprising a pocketed target formed of flexible material, the pockets of the target having open tops disposed in a common horizontal plane, said pockets being disposed orthogonally in rows with a smallest pocket at the center of the target bounded on opposite sides thereof by larger pockets, said target having still larger pockets at its corners, the target being rectangular and having a horizontal marginal flange substantially in the plane occupied by the tops of the pocket, an underlying support frame for said marginal flange and being horizontal and supporting the target in a level plane at an elevation where the bottoms of the pockets are freely suspended while the pockets are held in an open state, corner support means for the frame including uprights spaced outwardly of the corners of the frame and target, and a flexible backstop of sheet material including a lower trough surrounding said target on three sides and attached to and being supported by said uprights.

8. A chip and putt golf practice device and game apparatus as defined in claim 7, and said pockets of the target being rectangular.

9. A chip and putt golf practice device and game apparatus as defined in claim 8, and an elongated approach ramp leading from the forward side of the target and including an inclined portion attached to said forward side substantially at the plane occupied by said marginal flange and the tops of the pockets and extending entirely across the forward side of the target.

10. A chip and putt golf practice device and game apparatus comprising a pocketed rectangular target with the pockets of the target having open tops disposed in a common horizontal plane, said pockets being disposed orthogonally in rows with the smallest pocket of highest achievement value at the center of the target bounded on opposite sides thereof by larger pockets, said target having still larger pockets at its corners, an underlying support frame supporting the target in a level plane, and a backstop including a lower trough surrounding said target on three sides, said lower trough providing a further scoring area of lesser achievement value.

* * * * *